US010590588B2

(12) United States Patent
Kim et al.

(10) Patent No.: US 10,590,588 B2
(45) Date of Patent: Mar. 17, 2020

(54) LAUNDRY APPARATUS

(71) Applicant: LG ELECTRONICS INC., Seoul (KR)

(72) Inventors: Woore Kim, Seoul (KR); Hyunwoo Noh, Seoul (KR); Sangwook Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 108 days.

(21) Appl. No.: 15/638,864

(22) Filed: Jun. 30, 2017

(65) Prior Publication Data

US 2018/0057995 A1 Mar. 1, 2018

(30) Foreign Application Priority Data

Aug. 25, 2016 (KR) ..... 10-2016-0108329

(51) Int. Cl.

| | |
|---|---|
| ***D06F 39/04*** | (2006.01) |
| ***D06F 58/26*** | (2006.01) |
| ***D06F 58/02*** | (2006.01) |
| ***D06F 25/00*** | (2006.01) |
| ***D06F 37/04*** | (2006.01) |

(Continued)

(52) U.S. Cl.

CPC ..... *D06F 39/04* (2013.01); *D06F 25/00* (2013.01); *D06F 37/04* (2013.01); *D06F 37/22* (2013.01); *D06F 37/304* (2013.01); *D06F 58/02* (2013.01); *D06F 58/26* (2013.01)

(58) Field of Classification Search

None

See application file for complete search history.

(56) References Cited

U.S. PATENT DOCUMENTS 3,513,566 A 5/1970 Shacklock et al.
2004/0250442 A1* 12/2004 Ryu ..... D06F 25/00 34/140

(Continued)

FOREIGN PATENT DOCUMENTS

CN 102713047 10/2012
CN 103590224 2/2014

(Continued)

OTHER PUBLICATIONS

Induction heating wikipedia (Year: 2019).*

(Continued)

*Primary Examiner* — Cristi J Tate-Sims

(74) *Attorney, Agent, or Firm* — KED & Associates, LLP

(57) ABSTRACT

A laundry apparatus includes a drum rotatable on a shaft and including at least one predetermined region made of metal; a tub surrounding the drum; an inductor provided on the tub and heating the drum by generating an electromagnetic field; and an air passage duct including a first duct provided as a passage for exhausting air outside the tub, a second duct provided as a passage for sucking air into the tub, and a fan for generating air flow, wherein the air drawn into the tub via the second duct is supplied to an internal space of the drum via a penetrating hole provided in a circumferential surface of the drum by the fan and then exhausted to the first duct after passing through a drum opening provided in a front portion of the drum.

19 Claims, 9 Drawing Sheets

(51) Int. Cl.
*D06F 37/22* (2006.01)
*D06F 37/30* (2020.01)

(56) References Cited

U.S. PATENT DOCUMENTS

| | | | | |
|---|---|---|---|---|
| 2005/0138973 | A1* | 6/2005 | Hong | D06F 25/00 68/19.1 |
| 2005/0188471 | A1* | 9/2005 | Ahn | D06F 25/00 8/158 |
| 2005/0229647 | A1* | 10/2005 | Kim | D06F 25/00 68/20 |
| 2006/0169006 | A1* | 8/2006 | Lim | D06F 37/267 68/13 R |
| 2006/0225467 | A1* | 10/2006 | Lim | D06F 25/00 68/20 |
| 2008/0216249 | A1* | 9/2008 | Sa | D06F 25/00 8/158 |
| 2014/0123403 | A1* | 5/2014 | Zattin | D06F 25/00 8/137 |
| 2014/0123712 | A1 | 5/2014 | Kim et al. | |

FOREIGN PATENT DOCUMENTS

| | | | | |
|---|---|---|---|---|
| CN | 104846609 | | 8/2015 | |
| DE | 10 2008 043 281 | | 5/2010 | |
| EP | 1 710 339 | | 10/2006 | |
| EP | 2 400 052 | | 12/2011 | |
| EP | 2400052 | A1 * | 12/2011 | D06F 37/26 |
| GB | 1221343 | | 2/1971 | |
| JP | S 61-58694 | | 3/1986 | |
| JP | 06-121898 | | 6/1994 | |
| JP | 2000-213868 | | 8/2000 | |
| JP | 2004-135998 | | 5/2004 | |
| JP | 2005-177331 | | 7/2005 | |
| JP | 2007-082834 | | 4/2007 | |
| KR | 10-2003-0032169 | | 4/2003 | |
| WO | WO 2012/165785 | | 12/2012 | |

OTHER PUBLICATIONS

PCT International Search Report and Written Opinion dated Sep. 20, 2017 issued in Application No. PCT/KR2017/006821.
European Search Report dated Oct. 13, 2017 issued in Application No. 17182365.1.
Chinese Office Action dated Jun. 24, 2019 issued in Application No. 201710646637.1.
European Search Report dated Aug. 12, 2019 issued in Application No. 19177975.0.

* cited by examiner

LAUNDRY APPARATUS

CROSS-REFERENCE TO RELATED APPLICATION(S)

This application claims priority under 35 U.S.C. § 119 to Korean Application No. 10-2016-0108329 filed on Aug. 25, 2016, whose entire disclosure is hereby incorporated by reference.

BACKGROUND

1. Field

A laundry apparatus including an induction heater is disclosed herein.

2. Background

A laundry apparatus may be a washing machine, a dryer, a styler and so on. The washing machine may have a drying function, e.g., combination washer/dryer.

The washing machine may be categorized into a pulsator washing machine having a vertically oriented drum, and a drum washing machine having a horizontally oriented drum.

A user may put the washing machine into operation through manipulation of a course selecting interface. The user may select one of several courses by manipulating the course selecting interface and input setting details according to the selected course.

The course selecting interface may allow selection of a standard wash course, a baby course, a sterilize course, a speedy wash course, a lingerie course, a bedding course, etc. The setting details may include rinsing times during the rinsing course, spinning degree during the spinning course and/or the temperature of wash water.

When the user selects one of the courses displayed on a course selecting interface, a predetermined amount of wash water may be supplied to the laundry apparatus according to the load of the laundry loaded in the drum. Temperature of wash water may be raised so as to enhance washing efficiency, and to enhance the sterilization treatment effect for laundry.

For the washing and laundry sterilization effects, heated or warm water may be directly supplied to the washing machine from an external water supply source to raise the temperature of the wash water or an auxiliary heater is provided and heats the wash water in which the laundry is submerged so as to indirectly raise the temperature of the laundry. More specifically, it may be inconvenient to supply wash water into the washing machine to a water level at which all of the laundry is submerged so as to raise the temperature of the wash water.

It may also be inconvenient to heat not only the laundry but also the wash water so as to raise the temperature of the laundry. At this time, wash water has to be supplied or heated, which may cause serious waste of materials and energy.

Meanwhile, a dryer may be an electric or a gas appliance configured to dry wet clothes or washed clothes (hereinafter, laundry) by exposing them to a high temperature. The dryer may expose laundry to the hot air heated by a heater to expose the laundry to the heated air and evaporate the water elements contained in the laundry. The dryer may be an exhaustion type dryer or a circulation type dryer which heats air by using a heater to generate heated-air and expose the heated air to the laundry.

The heated air may fail to be uniformly supplied to the laundry. Specifically, a large amount of laundry or entangled laundry may not be exposed to the heated air uniformly so that drying efficiency might deteriorate. In addition, while heated air is supplied to the laundry which is partially wet so as to dry the laundry completely, the heated-air may be supplied even to the completely-dried laundry, resulting in damage to the laundry.

BRIEF DESCRIPTION OF THE DRAWINGS

The embodiments will be described in detail with reference to the following drawings in which like reference numerals refer to like elements wherein.

DETAILED DESCRIPTION

Figure 1:
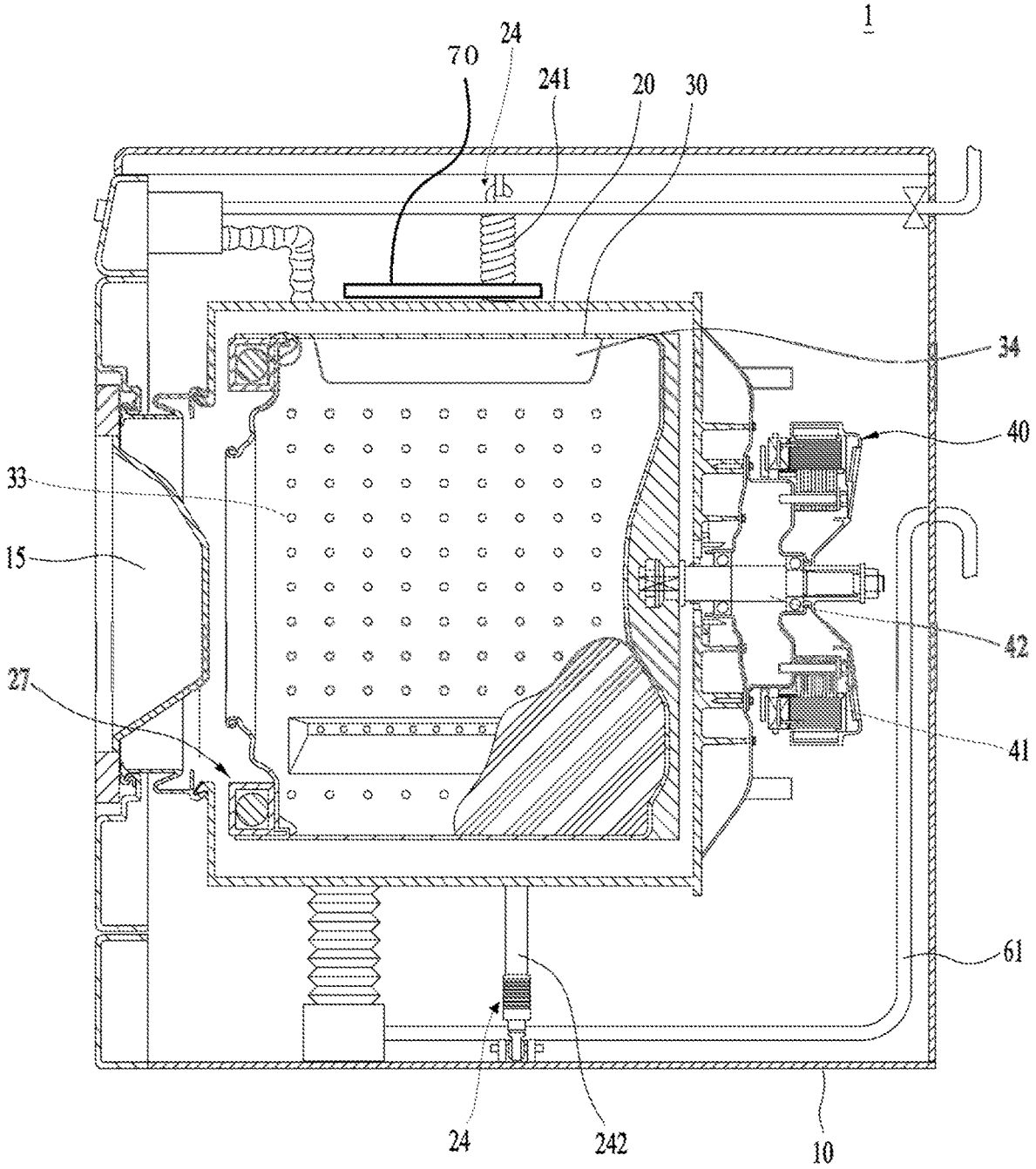
FIG. 1 is a schematic perspective diagram illustrating a laundry apparatus of the present disclosure.

As shown in FIG. 1, a laundry apparatus may include a cabinet 10, a tub 20, a drum 30, and an induction heater 70. The cabinet 10 defines an exterior of the laundry apparatus, and the tub 20 is provided in the cabinet and defining a certain space, with an opening provided in or at a front of the tub 20. The drum 30 may be rotatably provided in the space and may hold laundry. A predetermined region or entire surface of the drum 30 may be made of metal; and an induction unit (or induction heater) 70 may be provided at or on an outer circumferential surface of the tub 20 and configured to heat the drum 30, using an electromagnetic field. The tub 20 may have a cylindrical shape to rotatably accommodate the drum 30. The tub 20 may include a tub body 21, and a tub opening 22 configured to load laundry into the drum and projected a preset distance from the tub body 21.

The tub 20 may be supported within the cabinet 10 by a tub support unit (or tub support) 24. A damper 242 may support the tub body 21 in or at a lower portion of the cabinet and a spring 241 may be connected to the tub body 21 in or at an upper portion of the cabinet. The tub 20 may further include a connecting portion (or a collar) (26, see FIG. 2) that connects a tub front body and a tub rear body with each other and a securing portion or boss (25, see FIG. 2) configured to be secured to the induction unit 70.

Figure 7:
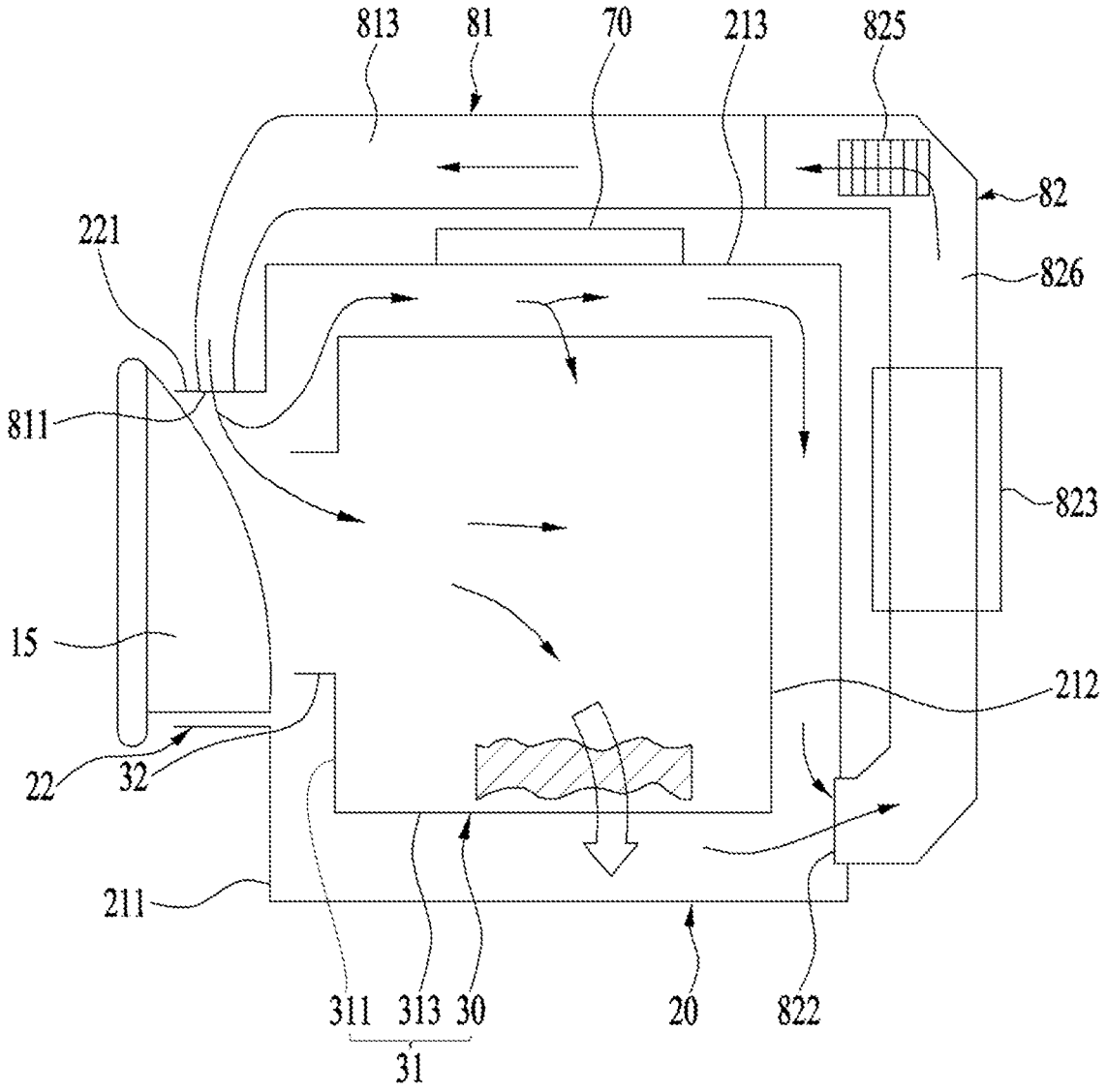
FIGS. 7 and 8 illustrate air flow in the laundry apparatus of the present disclosure.

Referring to FIG. 7, the drum 30 may include a drum body 31, and a drum opening 32 which allows laundry to be loaded into the drum. The drum opening 32 may be provided at a drum body front surface 311 of the drum body 31. The drum may also include a plurality of penetrating holes 33 configured to allow wash water and air to pass there through; and a plurality of lifts 34 to allow laundry to be lifted when stuck on a wall during a rotation of the drum 30.

Referring to FIG. 1 again, the laundry apparatus may further include a drive unit (or drive) 40 configured to rotate the drum within the tub 20. The drive unit 40 may be a motor 41 and may include a stator and a rotor. The rotor may be connected to a shaft 42 and the shaft 42 may be connected to the drum 30 so as to rotate the drum 30 within the tub 20.

The induction unit 70 may directly heat the drum 30. The induction unit 70 may include a coil 74 and a loading portion (or a housing) 72 to protect the coil 74. The housing 72 protects the coil from such undesirable substances as moisture or foreign substances that may be introduced into the coil 74 to cause a malfunction or deteriorate the magnetic field generation efficiency of the coil 74. The coil 74 may be wound in a shape of several circles. When electric currents are applied to the coil 74, an electromagnetic field passing through the coil may be generated. When an alternating current is applied to the coil 74, an AC magnetic field in which a direction of an alternating current is changed several times per second may be generated.

When a conductor is located near the vicinity of the coil 74, the alternating current may be applied to the conductor and an eddy current having a vortex shape may be generated by electromagnetic induction. The eddy current may be converted into Joule's heat by the resistance of the conductor so as to raise the temperature of the conductor. The loss of the induced magnetic force may raise a metal temperature.

The induction unit 70 may be provided in or at the tub 20. The induction unit 70 may be provided at any portion of the tub 20 including an inner portion or outer portion and the illustrated embodiment suggests that the induction unit 70 be provided on an outer surface of the tub 20. The present disclosure is not limited to this embodiment, and the induction unit 70 may be provided anywhere in the cabinet 10.

Humid air or wash water may be supplied to the internal space of the tub 20. If the induction unit 70 having the live coil is provided in the tub 20, there may be a risk of an electric shock or error. Thus the induction unit 70 in accordance with the illustrated embodiment may be provided on or at the outer surface of the tub 20.

Referring to FIG. 7, the induction unit 70 provided on the outer surface of the tub 20 may be provided on any portion of a tub body surface 211, a tub body rear surface 212 and a tub body circumferential surface 213, to allow heating of the drum 30.

In the embodiment, the induction unit 70 is provided on the tub body circumferential surface 213. The laundry held in the drum 30 may contact the drum body circumferential surface 313 of the drum body 31 and the drum body circumferential surface 313 may be close to the tub body circumferential surface 213. Accordingly, when the induction unit 70 is provided on the tub body circumferential surface 213, heating efficiency may be the highest.

Figure 2:
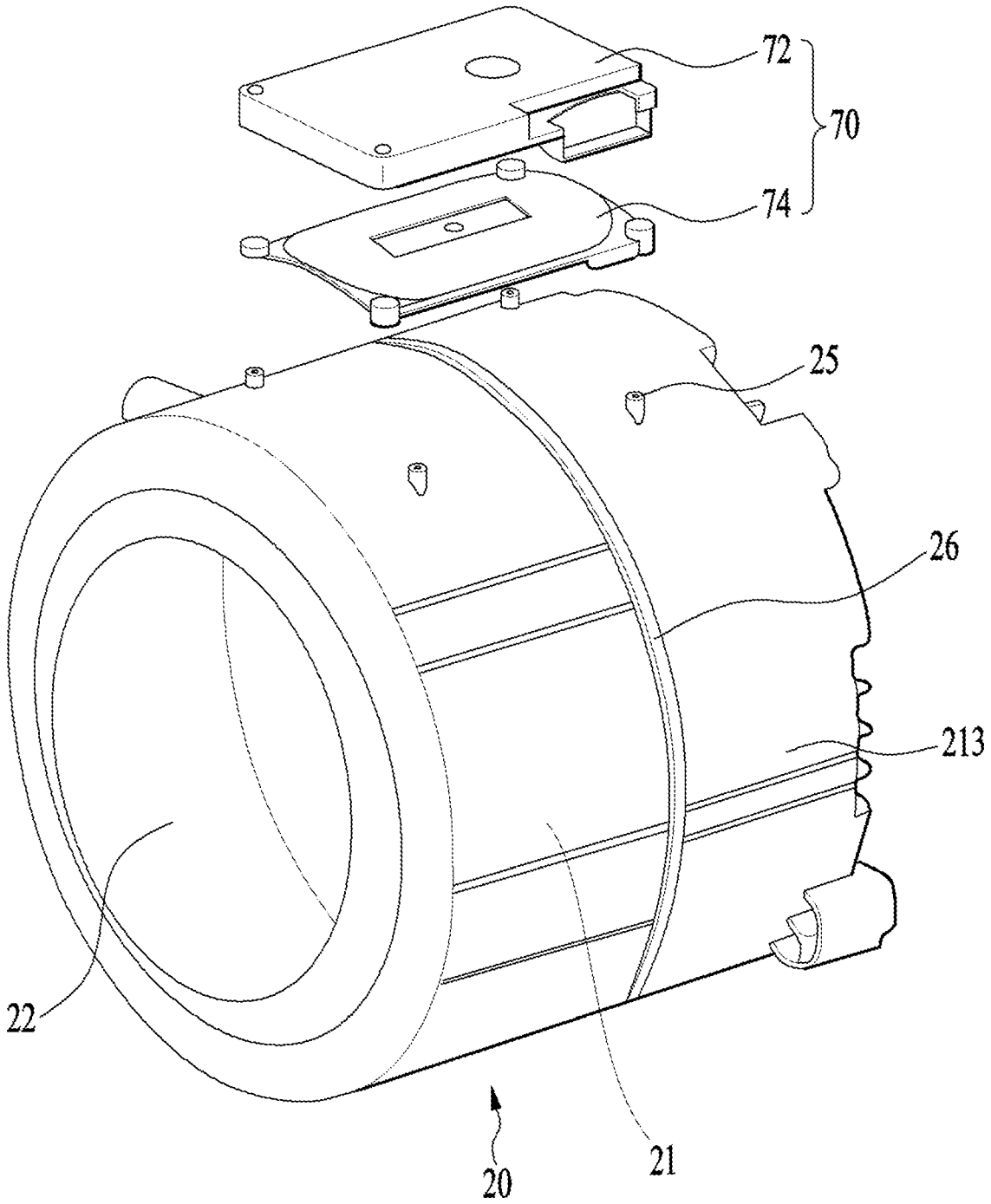
FIG. 2 is a diagram illustrating a laundry apparatus including an induction heater of the present disclosure.

FIG. 2 illustrates one embodiment of the present disclosure. The induction unit 70 may be provided on the tub body circumferential surface 213, e.g., on a circumferential top surface 213 of the tub body. When the induction unit 70 is put into operation, the drum 30 may be rotated by the drive unit 40. Because the induction unit 70 is fixedly installed on the tub body circumferential surface 213, unless the drum 30 is rotated, a predetermined region of the drum 30, or only a certain surface on the circumferential surface 313 of the drum 30 may be continuously heated and the laundry located near the heated surface may be damaged. Accordingly, the drum 30 may require rotation when the induction unit 70 is operated.

Even if the induction unit 70 is provided at any region of the tub body circumferential surface 213, the whole region of the rotating drum 30 may be heated. However, if the induction unit 70 is driven for a short time, the drum 30 may not be rotated or rotated occasionally upon need.

To prevent the tub 20 from being heated by the induction unit 70, the tub 20 may be a nonconductor or made from non-electrically conductive material. Stiffness of the tub 20 may be maintained by preventing the tub from being heated.

The coil 74 may be provided over the entire area of the tub body circumferential surface 213 or long enough to wind the tub body circumferential surface 213 at least one time. The induction unit 70 mentioned above may facilitate the sterilization treatment of laundry even without wash water. In other words, the laundry need not be submerged in the wash water for the sterilization treatment so that wash water can be saved.

When sterilizing the tub 20 and the drum 30 after the washing, a small amount of wash water or no wash water may be used to obtain the sterilization effect. In addition, the same sterilization effect may be obtained even when a small amount of wash water is used. It may not be necessary to heat much wash water with a high specific heat. Accordingly, energy may be saved. Also, the drying of the laundry may be performed even without additionally heating air.

The related art laundry apparatus may include a heater provided at a lower portion of the tub. However, the heater structure may be omitted in the laundry apparatus in accordance with the embodiment and the volume of the tub may be then increased. When the volume of the tub is increased, the drum capacity increases to receive more items to be washed without increase in the dimension of the cabinet.

Figure 3:
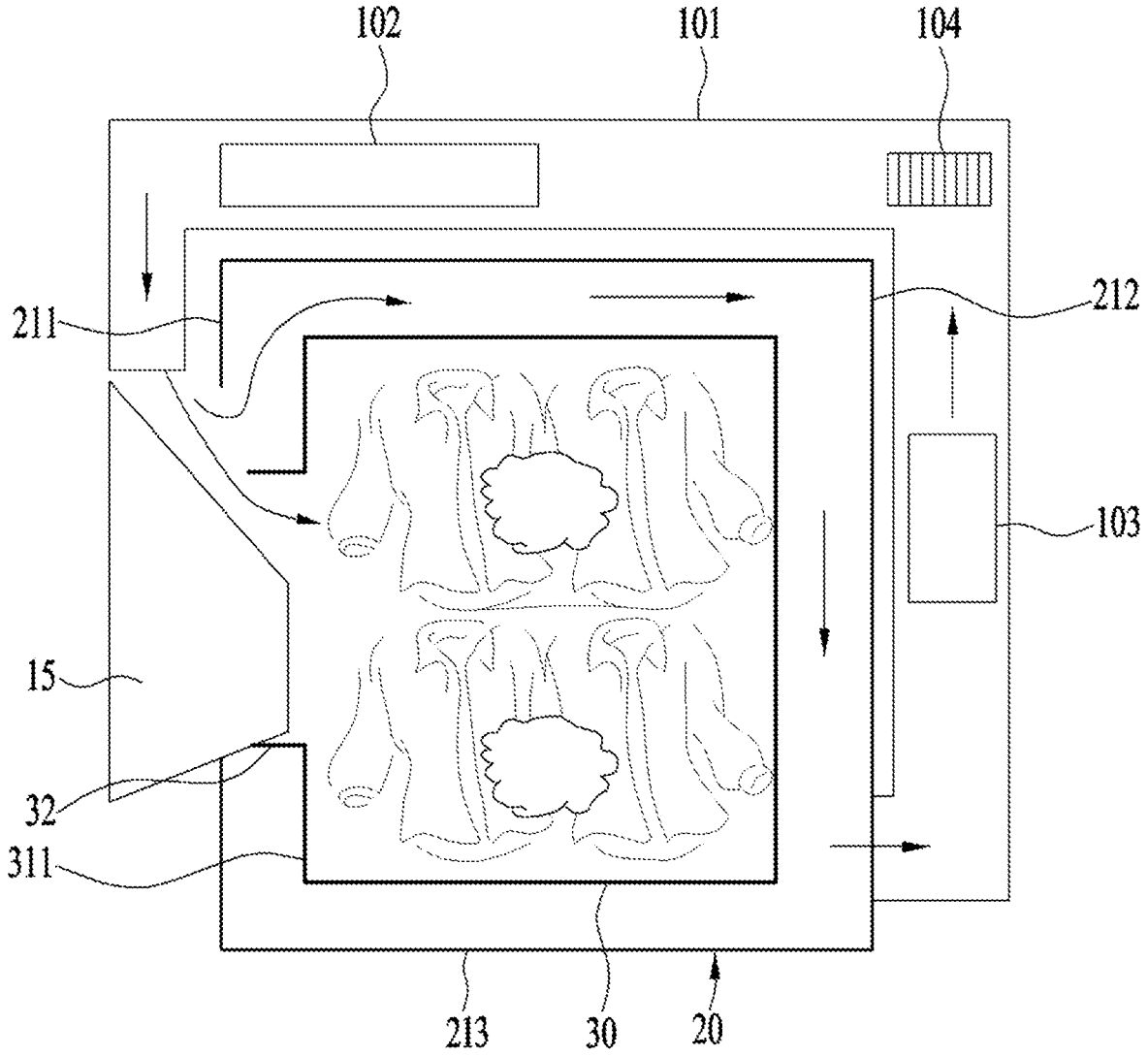
FIG. 3 is a diagram illustrating air flow in a related art laundry apparatus.

Hereinafter, the configuration and embodiments for air flow while a drying mode is performed in the laundry apparatus will be described. First of all, for comparison with the laundry apparatus in accordance with the present disclosure, air flow in the related art laundry apparatus will be described referring to FIGS. 3 and 4.

The related art laundry apparatus may generate air flow to dry the laundry held in the drum. In this instance, the related art laundry apparatus may condense and heat external air and then supply heated dry air to the laundry.

One end of an air duct 101 through which air passes may be located in or at an upper portion of a front surface of the tub 20 and the other end is located in a lower end of a rear surface of the tub 20. A condensation unit 103, a heater 102 for heating air, and a fan 104 for blowing air may be provided in the air duct 101.

Figure 4:
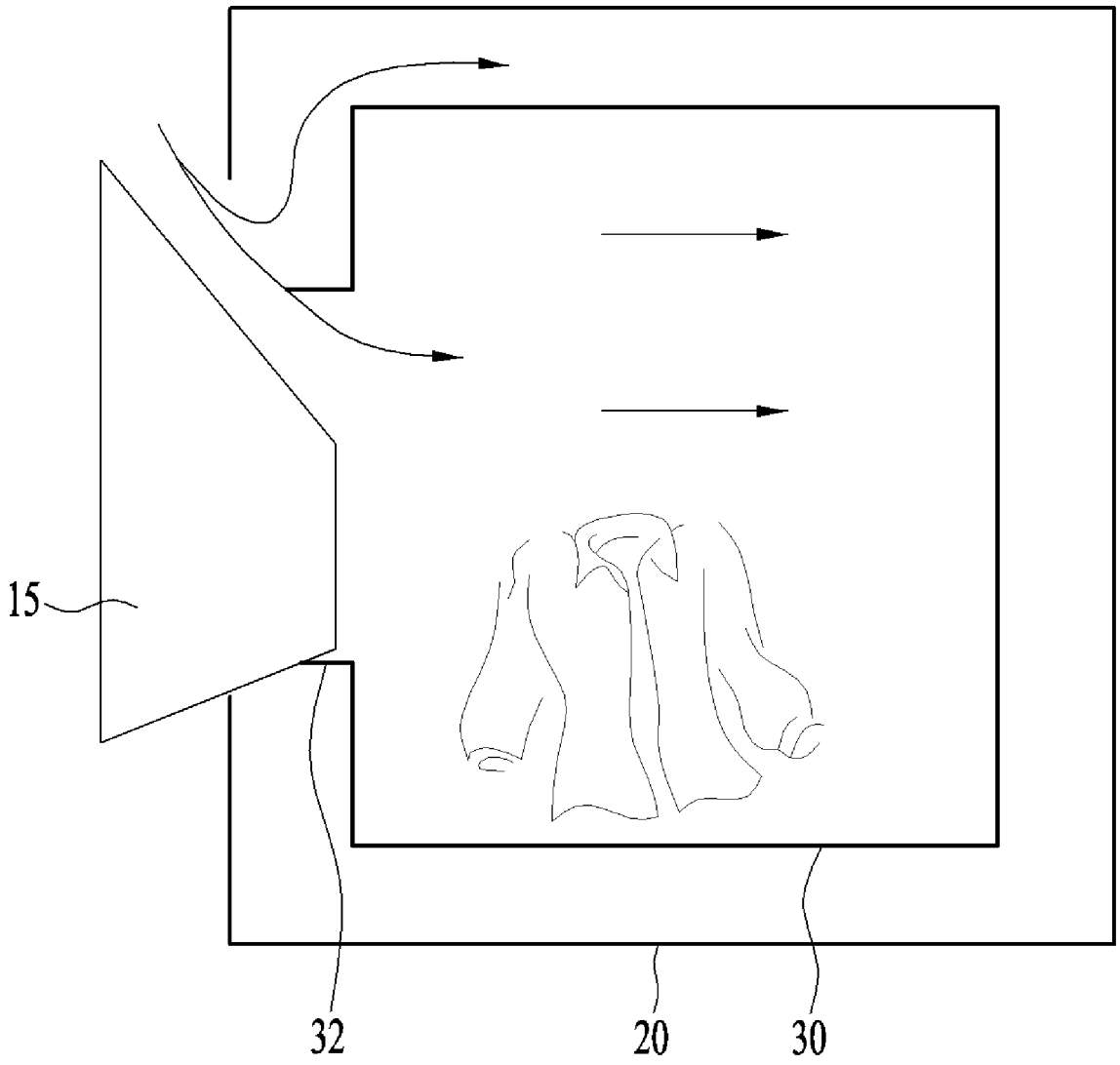
FIG. 4 illustrates the percentage of air flow in the related art laundry apparatus.

The air which has become dry while passing through the condensation unit 103 may be heated by the heater 102 and the heated dry air may then be supplied to the tub 20. At this time, some of the air drawn into the tub 20 via the front surface upper end may be supplied to the drum 30 to dry the laundry and some other air may be drawn into the gap formed between the tub 20 and the drum 30 to pass between the rear surface of the tub 20 and the rear surface of the drum 30 without heat-exchanging with the laundry and be exhausted to the air duct 101. As shown in FIG. 4, a respectable amount (45%) of the air drawn into the tub 20 may not exchange heat with the laundry, causing wasted power usage by heating air not used for drying.

Figure 5:
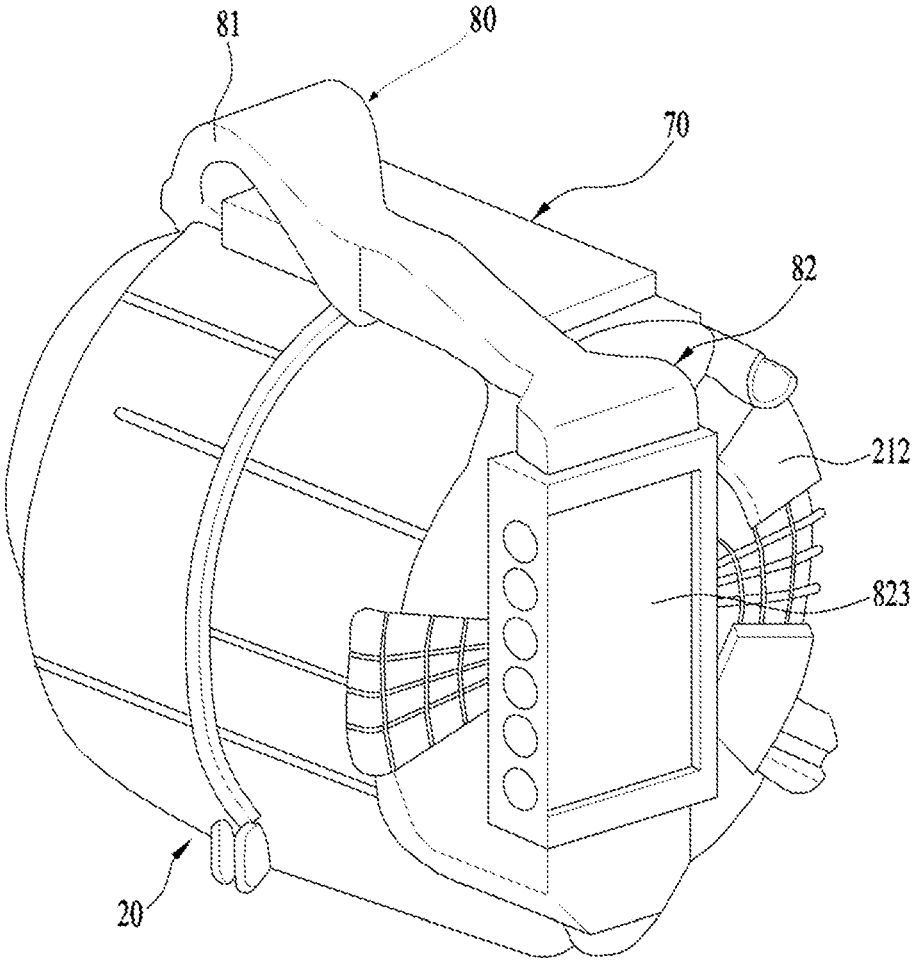
FIG. 5 is a perspective diagram illustrating the laundry apparatus of the present disclosure.
Figure 6:
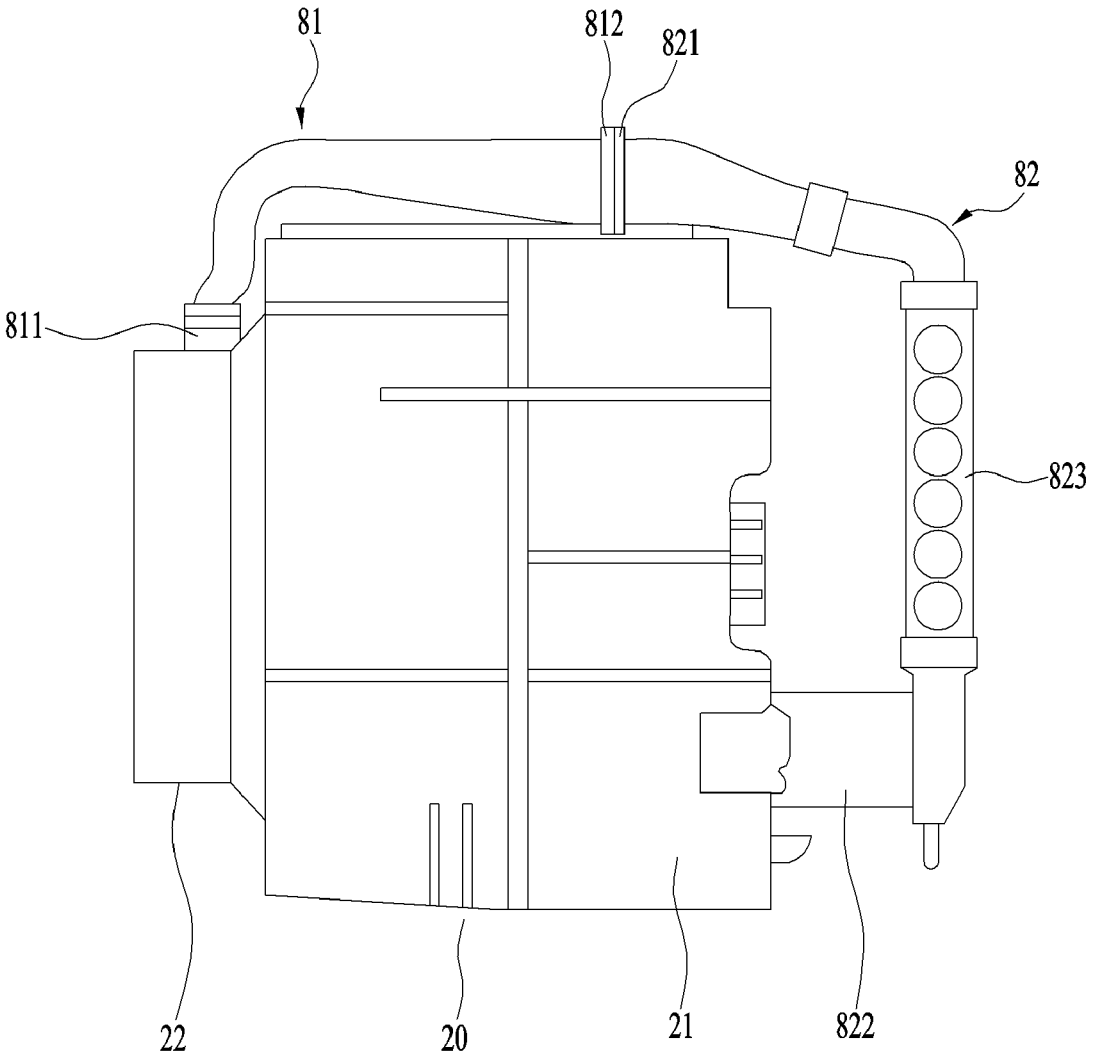
FIG. 6 is a side view of the laundry apparatus of the present disclosure.

FIGS. 5 and 6 illustrate the differences of the laundry apparatus in accordance with the present disclosure. FIGS. 5 and 6 illustrate a circulation type system for circulating internal air of the tub 20 and the embodiments of the present disclosure are not limited thereto. An exhaustion type system configured to dry the laundry held in the tub, using external air, and exhaust the humid air having dried the laundry outside again may be applicable.

The induction unit 70 and an air passage unit (or air passage duct) 80 for supplying air to the tub 20 may be provided on the circumferential surface 213 of the tub 20. The air passage unit 80 may include a first duct 81 having a first end in communication with the tub opening 22 and a second duct 82 having a first end in communication with the rear surface 212 of the tub 20.

In case of the circulation type system, a second end of the first duct 81 may be in communication with a second end of the second duct 82. Air may pass through the first duct 81, the tub 20 and the second duct 82 sequentially to flow to the first duct 81 again. In reverse, air may pass through the second duct 82, the tub 20 and the first duct 81 sequentially to flow to the second duct 82 again.

In case of the exhaustion type system, the second end of the first duct 81 and the second end of the second duct 82 may be in communication with an outside of the laundry apparatus. External air may be sucked into the tub 20 via the first duct 81 and exhausted outside via the second duct 82. In reverse, external air may be sucked into the tub 20 via the second duct 82 and exhausted outside via the first duct 81.

Referring to FIGS. 6 and 7, the first duct 81 may include a first duct inlet hole 811, a first duct outlet hole 812 and a first duct body 813. The first duct inlet hole 811 may be in communication with the tub opening circumferential surface 221 which is part of the tub opening 22. Alternatively, the first duct inlet hole 811 may be in communication with the tub body circumferential surface 213.

In the illustrated embodiment of the present disclosure, the first duct inlet hole 811 is in communication with the uppermost region of the tub opening circumferential surface 221. However, the embodiments of the present disclosure are not limited thereto and it may be in communication with an upper region of the tub opening circumferential surface 221.

Alternatively, the first duct inlet hole 811 may be in communication with the uppermost or upper region of the tub body circumferential surface 213. In this instance, the region in communication with the first duct inlet hole 811 may be closer to the tub body front surface 211 or tub body rear surface 212.

In case of the exhaustion type system, the first duct outlet hole 812 may be in communication with the cabinet 10 to facilitate flow of external air, or a gap formed between the cabinet 10 and the tub 20. In case of the circulation type system, the first duct outlet hole 812 may be in communication with the second duct 82.

The second duct 82 may include a second duct inlet hole 821, a second duct outlet hole 822 and a second duct body 826. The second duct body 826 may define a body of the second duct 82 and may be provided as a passage for air flow. In case the air passage unit 80 is a circulation type system, a heat exchanger 823 may be further provided to lower the humidity of the wet air.

In case of the exhaustion type system, the second duct inlet hole 821 may be in communication with the cabinet 10 to facilitate flow of external air, or the gap formed between the cabinet 10 and the tub 20. In case of the circulation type system, the second duct inlet hole 821 may be in communication with the first duct outlet hole 812.

The second duct outlet hole 822 may be in communication with the tub body rear surface 212 or the tub body circumferential surface 213. In one embodiment, the second duct outlet hole 822 is in communication with a lower region of the tub body rear surface 212. However, the embodiments are not limited thereto and the second duct outlet hole 822 may be in communication in any region of the tub body rear surface 212.

When the second duct outlet hole 822 is in communication with the tub body circumferential surface 213, the communication area may be a lower region of the tub body circumferential surface 213 or a rear region of the tub body circumferential surface (closer to the tub body rear surface 212). However, the embodiments of the present disclosure are not limited thereto and the second duct outlet hole 822 may be in communication with any region of the tub body circumferential surface 213. As mentioned above, the installation positions of the first duct inlet hole 811, the first duct outlet hole 812, the second duct inlet hole 821 and the second duct outlet hole 822 may be changeable.

The first duct 81 may be in communication with a position which is higher than the shaft of the drum and the second duct 82 may be in communication with a position which is lower than the shaft of the drum. Such a structure may allow the air sucked into the second duct 82 to flow into the first duct 81 after flowing into the drum diagonally. The air may flow diagonally in the drum so as to enlarge the contact area between the air and the laundry.

The air sucked into the second duct 82 may be supplied to the gap between the tub 20 and the drum. However, embodiments are not limited thereto and the second duct 82 may be provided to supply air to the drum directly. In one embodiment, the first duct inlet hole 811 and the second duct outlet hole 822 may be arranged to allow air to flow diagonally inside the tub 20 so as to maximize the washing and drying efficiency.

The first duct inlet hole 811 may be in communication with an upper region of the circumferential surface 221 of the tub opening. When air is drawn into the first duct inlet hole 811, the air may be directly sucked via the drum opening 32. When air is exhausted, the air may be directly drawn into the drum 30 via the drum opening 32. In other words, air may be drawn or exhausted via the tub opening 22 and the drum opening 22 without obstacles so that air can have freedom of flow.

The second duct outlet hole 822 may be in communication with a lower region of the tub body rear surface 212. In other words, the installation positions of the first duct inlet hole 811 and the second duct outlet hole 822 may allow air to flow diagonally in the tub 20 to allow air to contact with the laundry as much as possible.

Examples for forming the diagonal air flow movement may be diverse. The first duct inlet hole 811 may be in communication with an upper region of the circumferential surface 221 of the tub opening. The second duct outlet hole 822 may be in communication with the circumferential surface 213 of the tub body and arranged at a lower rear region of the tub body circumferential surface 213.

The first duct inlet hole 811 may be in communication with the circumferential surface 213 of the tub body and arranged at an upper front region of the circumferential surface 213 of the tub body (closer to the front surface 211 of the tub body). The second duct outlet hole 822 may be in communication with the circumferential surface 213 of the tub body and arranged at a lower rear region of the circumferential surface 213 of the tub body (closer to the rear surface 212 of the tub body).

Alternatively, the first duct inlet hole 811 may be in communication with the circumferential surface 213 of the tub body and arranged at an upper front region of the circumferential surface 213 of the tub body (closer to the front surface 211 of the tub body). The second duct outlet hole 822 may be in communication with a lower end of the rear surface 212 of the tub body. More specifically, the air passage unit 80 may be arranged in many different variations provided a diagonal line of air flow is formed in the tub 20.

In the embodiment configured to allow the air to flow diagonally, it may be easy to raise the temperature of the air. One embodiment suggests that the drum 30 is heated by using the induction unit 70, without auxiliary heating means provided in the air passage unit 80.

In other words, air may be supplied to the tub 20 by the operation of the fan 825 provided in the air passage unit 80. The drum 30 may be heated by the induction unit 70. The air drawn into the tub 20 may be heat-exchanged with the drum 30 and heated to dry the laundry held in the drum 30.

When the air flows diagonally, the area in which the air supplied to the tub 20 exchanges heat with the heated drum 30 may be increased.

Hereinafter, the air flow direction will be described under the premise that the air flows diagonally in the tub 20. In one embodiment shown in FIG. 7, air may flow to the first duct 81, the tub opening 22, the drum 30 and the second duct 82 and then flow to the first duct 81 again.

Some of the air drawn into the circumferential surface 221 of the tub opening via the first duct inlet hole 811 may be drawn into the drum body 31 via the drum opening and some of the air may be drawn between the circumferential surface 313 of the drum body and the circumferential surface of the tub body. In this instance, the air directly drawn into the drum body 31 via the drum opening 32 may be drawn into the drum body 31 without contacting the circumferential surface 313 of the drum body in which heating is substantially generated, so that the temperature of the air may not be high. In other words, the drying efficiency of the air drawn into the drum body 31 may be quite low.

The air having dried the laundry may exchange heat with the drum body circumferential surface 313 late (shown as a large arrow of FIG. 7) and may be exhausted outside the tub 20 via the second duct outlet hole 822. The air drawn between the drum body circumferential surface 313 and the tub body circumferential surface 213 may pass between the drum body rear surface 312 and the tub body rear surface 212 and be exhausted via the second duct outlet hole 822, without contacting with the clothes.

Figure 8:
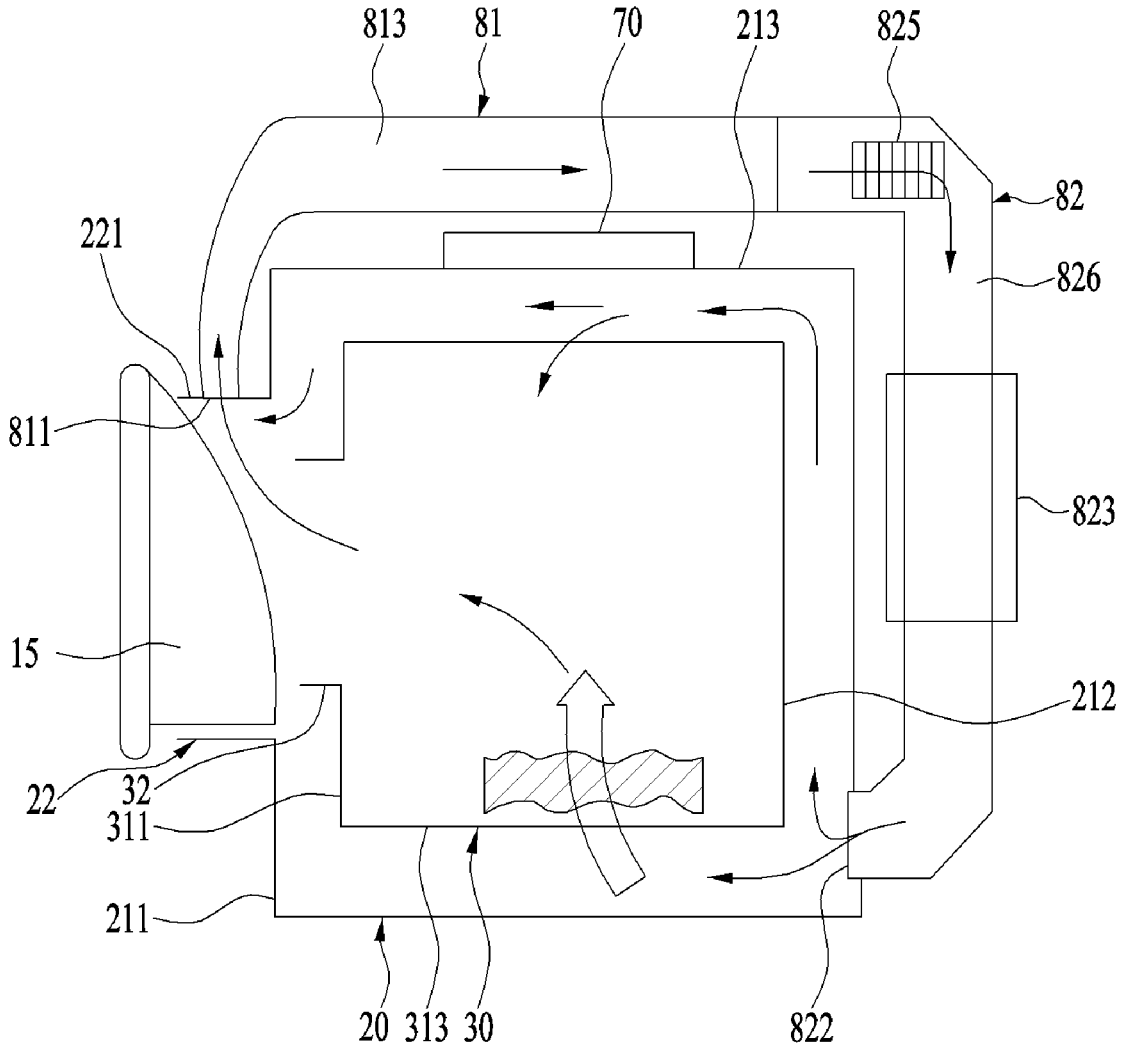

In one embodiment shown in FIG. 8, the air may sequentially flow to the second duct 82, the tub 20, the drum 30, and the first duct 81, and to the second duct 82 again. Most of the air exhausted via the second duct outlet hole 822 in communication with the rear surface 212 of the tub body or the rear surface of the tub body circumferential surface 213 may be drawn into the drum body 31 via the penetrating holes 33 formed in the drum body 31 (shown as a thick arrow of FIG. 8). More specifically, the air may be drawn into the drum body 31 after passing through the circumferential surface 313 of the drum body.

Accordingly, the circumferential surface 313 of the drum body heated by the induction unit 70 may exchange heat with the air and the heated air may dry the laundry held in the drum body 31. The humid air having dried the laundry may pass through the drum opening 32 to be exhausted into the first duct inlet hole 811 in communication with the upper region of the tub opening circumferential surface 221.

The humid air drawn into the first duct body 813 via the first duct inlet hole 811 may be condensed in the heat exchanger 823 provided in the second duct 826. The heat exchanger 823 may be an air cooling system or water cooling system. The relatively low-temperature dry air after heat-exchanging in the heat exchanger 823 may be drawn into the tub 20 via the second duct outlet hole 822 again.

The heat exchanger 823 may include the air cooling system and the water cooling system. Specifically, the heat exchanger 823 may include a first heat exchanger using the air cooling system and a second heat exchanger using the water cooling system to enhance heat exchanging efficiency more.

In the air passage unit 80 using the air exhaustion system, external air may be drawn into the tub 20 via the second duct 82 and may exchange heat with the laundry in the tub 20 as mentioned above. The humid air having exchanged heat may then be exhausted via the first duct 81. In this instance, the heat exchanger 823 need not be provided additionally.

When an air passage shown in FIG. 8 is formed, air may be heated efficiently even without an auxiliary structure provided in the air passage unit 80 to heat air. Before contacting with the laundry, air may exchange heat with the circumferential surface 313 of the drum body in the lower region of the tub 20. Accordingly, the drying effect may be remarkable, compared with the air flow shown in FIG. 7 which contacts with the laundry without the heating process.

In addition, the air heated in the lower region of the circumferential surface 313 of the drum body may tend to rise, which may reduce the power used in rotating the fan 825 to generate air flow advantageously. Most of the air drawn in the lower region of the tub 20 dries the laundry after exchanging heat with the circumferential surface 313 of the drum body, which may reduce the amount of the air supplied to the tub 20 advantageously, compared with the conventional amount of the air to dry the laundry.

The air drawn into the lower region of the tub 20 may be mostly used in drying the laundry so that the amount of the air supplied to the tub 20 may be reduced, compared with that of the air supplied to the tub 20 of the conventional laundry apparatus. In other words, the same drying effect may be obtained even if an RPM of the fan 825 is lower than RPM of the fan 825 provided in the conventional laundry apparatus. Also, not only the air but also the heated drum body 31 may be capable of drying the laundry which is directly in contact with the drum body 31, which results in obtaining a better drying effect compared with that of the conventional laundry apparatus which dries the laundry by using only the heated air.

A structure configured to remove the heat generated in the induction unit 70 and a controller controlling the operation of the controller 70 may be further provided. Specifically, an external air supply duct for supplying external air of the tub 20 to the induction unit 70 and the controller and an external air exhaust duct for exhausting the air supplied via the external air supply duct outside the tub 20 may be further provided.

When heat is generated in the induction unit 70 and the controller, the performance of the induction unit 70 may deteriorate and the controller may malfunction. To prevent this, external air may be used in cooling the induction unit 70 and the controller.

The induction unit 70 may be used in adjusting the timing for heating the drum 30. In accordance with one embodiment, the induction unit 70 may operate in a drying cycle to dry the laundry held in the drum 30, a spinning cycle to spin the laundry to dehydrate the laundry, and a sterilizing cycle to perform a sterilization treatment for the drum 30 and the tub 20.

The drying cycle, the spinning cycle, and the sterilizing cycle may be provided as independent courses, respectively, or performed in courses combined with one or more cycles.

For example, a drying-spinning course in which the drying cycle and the spinning cycle are performed simultaneously may be provided and the induction unit 70 may operate even in the drying-spinning course.

As occasion demands, the induction unit 70 may not operate in the drying cycle or the spinning cycle. For example, a spinning or drying course may be performed only using air ventilation.

When the induction unit 70 operates to heat the drum 30, the drum 30 may be rotated by the drive unit 40. The drum 40 may be uniformly heated to perform the drying cycle, the spinning cycle and the sterilizing cycle efficiently.

In case of supplying heated air to the tub 20, using the related art heater, a remarkable amount of the supplied hot air may leak between the drum 30 and the tub 20 such that the tub 20 may be heated unnecessarily. The rear surface of the tub on which the drive unit 40 is provided may be relatively weak compared with other regions. Accordingly, the rear surface of the tub 20 may become damaged by the hot air disadvantageously.

However, in one embodiment of the laundry apparatus including the induction unit 70, the induction unit 70 may heat only the drum 30 provided as the conductor, not the tub 20. Accordingly, the embodiments may have a remarkable effect for maintaining the stiffness of the tub. In the embodiment, the tub 20 may include a plastic material provided as a nonconductor. The tub 20 may be made of any material so as to not be heated by the induction unit 70 as the nonconductor.

Meanwhile, cold air may be additionally supplied to the tub 20. The tub 20 may be affected by the heat generated in the heated drum 30, and cold air may then be supplied to the internal space of the tub 20 so as to maintain the stiffness of the tub 20.

Figure 9:
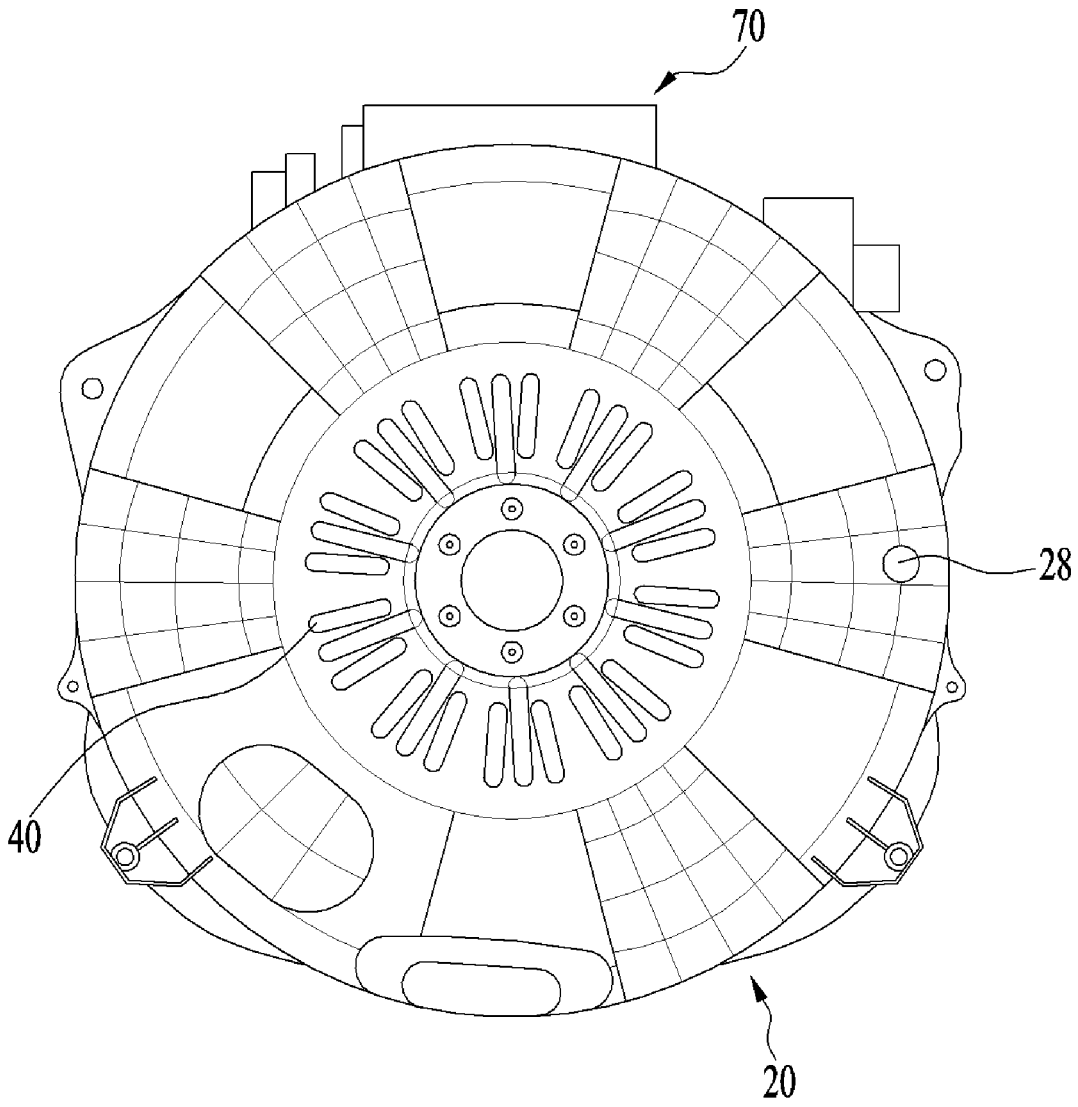
FIG. 9 illustrates a rear surface of a tub body in which a cold air inlet hole of the present disclosure.

FIG. 9 illustrates the tub body rear surface 212 in accordance with one embodiment. A cold air inlet hole 28 may be further provided at the tub body rear surface 212 to supply cold air to the tub.

The cold air inlet hole 28 may be provided on a virtual line which is parallel to the ground, passing the center of the tub body rear surface 212. If the cold air inlet hole 28 is located higher than the center of the tub body rear surface 212, the supplied cold air may reach an outer surface of the drum 30. Accordingly, the cold air inlet hole 28 should be located lower than or parallel with the center of the tub body rear surface 212. The cold air supplied via the cold air inlet hole 28 may flow along the inner surface of the tub 20 and cool the tub 20.

In the illustrated embodiment, the cold air supply inlet 28 is provided in or at the tub body rear surface 212. However, the embodiments are not limited thereto and the cold air supply inlet 28 may be provided on the tub body circumferential surface 213. Even if the cold air inlet hole 28 is provided on the tub body circumferential surface 213, the height of the cold air inlet hole 28 may be equal to or lower than a height of the center of the tub body rear surface 212.

One embodiment may include a controlling method of the laundry apparatus, using the induction unit 70. The controlling method may control the laundry apparatus which includes the drum 30 rotatably provided and having at least a predetermined region made of metal; the tub 20 holding the drum 30; the induction unit 70 provided in the tub 20 and heating the drum 30 by generating the electromagnetic field; and the air passage unit 80 including the first duct 81 provided as a passage for exhausting air outside the tub 20, a second duct 82 provided as a passage for sucking air into the tub 20, and the fan 825 generating air flow.

Specifically, the controlling method may include a washing-rinsing course for washing and rinsing laundry; and a spinning-drying course for removing moisture from the laundry. In the spinning-drying course, the drum may be rotated and the induction unit may heat the drum. The spinning-drying course may correspond only to the drying cycle or the spinning cycle or a course in which the drying and spinning cycles are performed simultaneously.

During the spinning-drying course, the fan 825 may generate air flow. The drum 30 heated by the induction unit 70 may exchange heat with the air sucked by the fan 825 and the heat-exchanged air may remove the moisture contained in the laundry loaded in the drum 30.

The spinning-drying course may be performed by using the induction unit 70 and only the drum 30 may be selectively heated. Accordingly, the unnecessary heat supplied to the tub 20 may be prevented and the stiffness of the tub 20 may be maintained advantageously.

During the spinning-drying course, cold air may be supplied to the inner surface of the tub 20. This may prevent the heated drum from damaging the tub 20 even if only the drum 30 is selectively heated by using the induction unit 70. The cold air inlet hole 28 may be further provided in the tub 20 to supply cold air and the detailed description of the cold air inlet hole 28 may be the same as described above and omitted accordingly.

The washing-rinsing course may include only the washing cycle or the rinsing cycle or may be a course in which the washing cycle and the rinsing cycle are performed sequentially or alternatively. When the supplied wash water needs to be heated, the drum 30 may be rotated and the induction unit 70 may heat the drum 30 during the washing-rinsing course. The induction unit 70 may heat both wash water and air.

An object of the present disclosure is to overcome the disadvantages of the related art. Embodiments of the present disclosure provide a laundry apparatus which is capable of soaking or sterilizing laundry when the laundry is not submerged in wash water.

Embodiments of the present disclosure also provide a laundry apparatus which is capable of raising the temperature of laundry without heating wash water. Embodiments of the present disclosure also provide a laundry apparatus which is capable of drying the laundry uniformly even if laundry is entangled or a large amount of laundry is loaded.

Embodiments of the present disclosure also provide a laundry apparatus which has a high energy and wash-water consumption efficiency. Embodiments of the present disclosure also provide a laundry apparatus which is capable of improving washing efficiency and drying efficiency. Embodiments of the present disclosure also provide a laundry apparatus which is capable of maintaining stiffness of a tub provided therein.

A laundry apparatus may include a drum rotatable on a shaft and comprising at least a predetermined region made of metal; a tub holding the drum; an induction unit provided on the tub and heating the drum by generating an electromagnetic field; and an air passage unit comprising a first duct provided as a passage for exhausting air outside the tub, a second duct provided as a passage for sucking air into the tub, and a fan for generating air flow, wherein the air drawn into the tub via the second duct is supplied to an internal space of the drum via a penetrating hole provided in a circumferential surface of the drum by the fan and then exhausted to the first duct after passing through a drum opening provided in a front portion of the drum.

The tub may comprise a tub body defining a main body and a tub opening formed in a front portion of the tub, and the first duct may be in communication with the tub opening or the tub body and the second duct is in communication with the tub body. The first duct may be in communication with a tub body front surface of the tub body or a tub body circumferential surface of the tub body.

The second duct may be in communication with a tub body rear surface of the tub body or the tub body circumferential surface. The first duct may be in communication with a region located higher than the shaft and the second duct may be in communication with a region located lower than the shaft.

The air drawn from the second duct may be supplied to a gap formed between the tub and the drum. The tub may comprise a tub body defining a main body and a tub opening formed in a front surface of the tub, and the induction unit is provided in a tub body circumferential surface of the tub body.

One end of the first duct and one end of the second duct may be in communication with the tub, and the other end of the first duct and the other end of the second duct may be in communication with each other outside the tub. The second duct may comprise a heat exchanger configured to condense the moisture in the air circulating in the tub, and the heat exchanger may be a water cooling type or an air cooling type. The heat exchanger may comprise a water cooling type heat exchanger and an air cooling type heat exchanger.

The laundry apparatus may further comprise a controller controlling the operation of the induction unit; an external air supply duct supplying external air to the induction unit or the controller; and an external air exhaust duct exhausting the air sucked via the external air supply duct. The induction unit may heat the drum when the drum rotates.

One embodiment provides a laundry apparatus including a rotatable drum. Cold air may be supplied to an inner surface of the tub in a drying cycle or a spinning cycle. A cold air inlet hole for drawing cold air into the tub may be provided in a rear surface of the tub.

Embodiments of the present disclosure also provide a controlling method of a laundry apparatus comprising a drum rotatably provided and comprising at least a predetermined region made of metal; a tub holding the tub; an induction unit provided on the tub heating the drum by generating an electromagnetic field; and an air passage unit comprising a first duct provided as a passage for exhausting air outside the tub, a second duct provided as a passage for drawing air into the tub, and a fan for generating air flow, the controlling method comprising a washing-rinsing course for washing and rinsing laundry; and a spinning-drying course for removing moisture from the laundry, wherein the drum is rotated and the induction unit heats the drum in the spinning-drying course.

The fan may operate in the spinning-drying course. Cold air may be supplied to an inner surface of the tub in the spinning-drying course.

A cold air inlet hole for drawing cold air into the tub may be provided at a rear surface of the tub. In the washing-rinsing course, the drum may rotate when heating the supplied wash water and the induction unit heats the drum.

According to the embodiments of the present disclosure, the laundry apparatus has an effect of laundry soaking or sterilizing when the laundry is not submerged in wash water.

Furthermore, the laundry apparatus may raise the temperature of the laundry effectively, even without heating the wash water. Still further, the laundry apparatus may dry the laundry uniformly, even when a large amount of laundry is provided or the laundry is entangled. Still further, the laundry apparatus has an effect of high wash-water and energy consumption efficiency.

Still further, the laundry apparatus has an effect of high washing and drying efficiency. Still further, the laundry apparatus is capable of maintaining the stiffness of the tub. Although the laundry apparatus as presently described is a joint washer and dryer, the same features may be applied to a stand alone dryer having a single rotatable drum inside a cabinet.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry apparatus comprising:

a tub, the tub including a tub body and a tub opening formed at a front of the tub body;

a drum rotatable on a shaft and provided in the tub, the drum having at least a predetermined region of a circumferential surface made of metal, the drum having a plurality of penetrating holes provided in the circumferential surface of the drum;

an inductor provided on the tub body and configured to heat the predetermined region of the circumferential surface of the drum by generating an electromagnetic field;

an air passage duct including a first duct and a second duct; and a fan configured to generate air flow through the air passage duct, the first duct being in communication with the tub opening or a front portion of the tub body and the second duct being in communication with a rear portion of the tub body, wherein air provided into the tub via the second duct is supplied to an internal space of the drum via the plurality of penetrating holes provided in the circumferential surface of the drum by the fan after exchanging heat with the circumferential surface of the drum and then exhausted to the first duct after passing through a drum opening provided at a front portion of the drum.

2. The laundry apparatus of claim 1, wherein the first duct is in communication with a hole in either a front surface of the tub body or a circumferential surface of the tub body.

3. The laundry apparatus of claim 1, wherein the second duct is in communication with a hole in either a rear surface of the tub body or the circumferential surface of the tub body.

4. The laundry apparatus of claim 1, wherein the first duct is in communication with a region located higher than the shaft and the second duct is in communication with a region located lower than the shaft.

5. The laundry apparatus of claim 4, wherein the air drawn from the second duct is supplied to a gap formed between the tub and the drum.

6. The laundry apparatus of claim 1, wherein the tub includes a tub body defining a main body and a tub opening formed at a front surface of the tub, and the inductor is provided on a circumferential surface of the tub body.

7. The laundry apparatus of claim 1, wherein a first end of the first duct and a first end of the second duct are in communication with the tub, and a second end of the first duct and a second end of the second duct are in communication with each other outside the tub.

8. The laundry apparatus of claim 7, wherein the second duct includes a heat exchanger configured to condense the moisture in the air circulating in the tub, and the heat exchanger is a water cooling type or an air cooling type.

9. The laundry apparatus of claim 8, wherein the heat exchanger includes a water cooling type heat exchanger and an air cooling type heat exchanger.

10. The laundry apparatus of claim 1, further including:

a controller controlling the operation of the inductor;

an external air supply duct supplying external air to the inductor or the controller; and an external air exhaust duct exhausting the air sucked via the external air supply duct.

11. The laundry apparatus of claim 1, wherein the inductor heats the drum when the drum rotates.

12. The laundry apparatus of claim 11, wherein cold air is supplied to an inner surface of the tub in a drying cycle or a spinning cycle.

13. The laundry apparatus of claim 12, wherein a cold air inlet hole that draws cold air into the tub is provided in a rear surface of the tub.

14. The laundry apparatus of claim 1, wherein the inductor is provided on the tub.

15. The laundry apparatus of claim 1, further comprising:

a heat exchanger provided in the second duct, wherein air provided through the drum is drawn into the heat exchanger to be dehumidified and resupplied back to the drum.

16. The laundry apparatus of claim 15, wherein the first duct is in communication with a front of the drum at a location higher than the shaft, and the second duct is in communication with a rear of the drum at a location lower than the shaft.

17. The laundry apparatus of claim 1, wherein at least a portion of air introduced to a rear region of the tub lower than the shaft is heated by the circumferential surface of the drum before entering interior space of the drum through the plurality of penetrating holes and is exhausted from interior space of the drum through a front region of the tub higher than the shaft.

18. The laundry apparatus of claim 17, wherein the inductor is turned on when the drum is rotated.

19. The laundry apparatus of claim 18, wherein the inductor is provided on a circumferential surface of the tub.

* * * * *